US010138840B2

(12) United States Patent
Ruona et al.

(10) Patent No.: US 10,138,840 B2
(45) Date of Patent: Nov. 27, 2018

(54) PTWA COATING ON PISTONS AND/OR CYLINDER HEADS AND/OR CYLINDER BORES

(71) Applicant: FORD GLOBAL TECHNOLOGIES, LLC, Dearborn, MI (US)

(72) Inventors: William Charles Ruona, Farmington Hills, MI (US); Rick L. Williams, Canton, MI (US); Thomas G. Leone, Ypsilanti, MI (US); Clifford E. Maki, New Hudson, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 791 days.

(21) Appl. No.: 14/627,648

(22) Filed: Feb. 20, 2015

(65) Prior Publication Data

US 2016/0245224 A1 Aug. 25, 2016

(51) Int. Cl.

| | |
|---|---|
| ***F02F 1/42*** | (2006.01) |
| ***F02F 3/10*** | (2006.01) |
| ***C23C 4/131*** | (2016.01) |
| ***C23C 4/02*** | (2006.01) |
| ***C23C 4/08*** | (2016.01) |
| ***C23C 4/18*** | (2006.01) |
| ***C23C 4/01*** | (2016.01) |
| ***F02F 3/12*** | (2006.01) |

(52) U.S. Cl.

CPC ..... *F02F 3/10* (2013.01); *C23C 4/01* (2016.01); *C23C 4/02* (2013.01); *C23C 4/08* (2013.01); *C23C 4/131* (2016.01); *C23C 4/18* (2013.01); *F02F 3/12* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,539,192 | A | 11/1970 | Prasse | |
| 4,997,024 | A | 3/1991 | Cole et al. | |
| 5,573,814 | A * | 11/1996 | Donovan | C23C 4/16 427/448 |
| 6,044,820 | A | 4/2000 | Domanchuk et al. | |
| 6,422,008 | B2 | 7/2002 | Voss et al. | |
| 6,703,579 | B1 * | 3/2004 | Rice | B23K 10/006 219/121.47 |

(Continued)

FOREIGN PATENT DOCUMENTS

| | | | | |
|---|---|---|---|---|
| DE | 102012007264 A1 * | 3/2013 | | F02F 1/004 |
| WO | 2011044979 A1 | 4/2011 | | |

OTHER PUBLICATIONS

Machine Translation of DE102012007264A1 PDF File Name: "DE102012007264A1_Machine_Translation.pdf".*

*Primary Examiner* — Lindsay Low
*Assistant Examiner* — Ruben Picon-Feliciano
(74) *Attorney, Agent, or Firm* — Brooks Kushman P.C.

(57) ABSTRACT

A surface of a piston and/or a cylinder head and/or a cylinder bore of an internal combustion cylinder with selectively applied plasma transferred wire arc coating which acts as a thermal barrier improving fuel efficiency and reducing fuel emissions and a method of producing the plasma transferred wire arc coating on a surface of a piston and/or cylinder head and/or a cylinder bore of a compression ignition and/or spark ignition engine.

16 Claims, 4 Drawing Sheets

(56) References Cited

U.S. PATENT DOCUMENTS

| | | | | |
|---|---|---|---|---|
| 6,706,993 | B1 * | 3/2004 | Chancey | B05B 7/224 219/121.47 |
| 7,458,358 | B2 | 12/2008 | Lineton et al. | |
| 2003/0015419 | A1 | 1/2003 | Bakir et al. | |
| 2003/0154919 | A1 * | 8/2003 | Rice | B05B 12/20 118/504 |
| 2004/0226547 | A1 * | 11/2004 | Holzleitner | C23C 4/16 123/668 |
| 2010/0080982 | A1 | 4/2010 | Racek et al. | |
| 2010/0173092 | A1 * | 7/2010 | Wachter | C09J 7/29 427/448 |
| 2012/0048227 | A1 | 3/2012 | Tricoire | |
| 2012/0058363 | A1 * | 3/2012 | Verpoort | C23C 4/08 428/649 |
| 2012/0216771 | A1 | 8/2012 | Daiker et al. | |
| 2013/0025561 | A1 * | 1/2013 | Gabriel | C23C 4/04 123/193.6 |
| 2015/0211437 | A1 * | 7/2015 | Stong | F02F 3/14 92/223 |

* cited by examiner

PTWA COATING ON PISTONS AND/OR CYLINDER HEADS AND/OR CYLINDER BORES

TECHNICAL FIELD

The invention is directed to a coating applied by plasma transferred wire arc (PTWA) method to a surface of pistons and/or cylinder heads and/or cylinder bores.

BACKGROUND

Various strategies have been developed to improve automotive fuel efficiency and emissions reduction. For example, emissions reduction has been achieved by employing catalysts in the catalytic converters, and developing automotive parts from lightweight materials has been implemented to reduce weight of vehicles. A plasma transferred wire arc (PTWA) coating application on an aluminum alloy cylinder bores has proven to offer several advantages besides weight reduction. For example, the PTWA coating on cylinder bores reduces weight, cost, and bore spacing when compared to an aluminum engine block with thick iron cylinder liners.

Other engine parts contribute to fuel inefficiency and hydrocarbon emissions. For example, inserts and cast-in reinforcements within the internal combustion cylinder are used to provide sufficient strength to various cylinder parts. For instance, a cast-in reinforcement is used at an area of the top ring groove on a piston. However, the reinforcement increases the weight of the piston. Such reinforcements also add to noise, vibration, and cost. Other engine parts, such as the top land of the pistons, are known major sources of hydrocarbon emissions due to the crevice volume effect which also causes a significant efficiency penalty. Decreasing the crevice volume effect translates into improved fuel efficiency and lower hydrocarbon emissions. Therefore, there has been a long felt need to develop additional methods for reducing automotive emissions and increasing fuel efficiency.

SUMMARY

A method comprising a step of selectively masking a surface portion of an internal combustion engine cylinder to obtain a masked portion and an exposed portion is disclosed. The method further includes a step of applying a plasma transferred wire arc (PTWA) material including a catalytic material to the exposed portion to obtain a selective PTWA coating. The applying step includes applying the PTWA material to only the exposed portion. The internal combustion engine cylinder includes a piston. The surface portion includes a piston surface portion. The exposed portion includes one or more of a piston top ring land surface, a piston top ring groove surface, a piston bowl surface, and a piston intake valve surface. The internal combustion engine cylinder includes a cylinder head. The surface portion includes a cylinder head surface portion. An exposed portion includes a bridge surface between exhaust valves, a bridge surface between a spark plug and an exhaust valve, a bridge surface between a direct injection fuel injector and an exhaust valve, a bridge surface between a spark plug and a direct injection fuel injector, and a valve seat surface. The method may further include a step of roughening the surface before applying the PTWA material. The catalytic material includes one or more of platinum, palladium, rhodium, copper, and copper-nickel alloy. The method may further include a step of smoothing the selective PTWA coating by burnishing and/or wire brushing to obtain a smoothed selective PTWA coating. The smoothed PTWA coating has a thickness of about 25-50 μm. A selective PTWA coating has a thickness of about 90-150 μm.

A method comprising applying a plasma transferred wire arc (PTWA) material including a catalytic material to substantially all of surface regions of a compression ignition engine piston to obtain a PTWA coated piston including deposited PTWA material is disclosed. The catalytic material may include one or more of platinum, palladium, rhodium, copper, and copper-nickel alloy. The method may further include a step of smoothing the surface of the PTWA coated piston by burnishing and/or wire brushing to obtain a smoothed PTWA coating. The smoothed PTWA coating has a thickness of about 25-50 μm. A deposited PTWA material has a thickness of about 90-150 μm.

An internal combustion cylinder comprising a cylinder head having a cylinder head surface; a piston having a piston surface; a cylinder bore having a cylinder bore surface; and a selective plasma transfer wire arc ("PTWA") coating including a catalytic material contacting the cylinder head surface and/or the piston surface and/or the cylinder bore surface is disclosed. The catalytic material may include platinum, palladium, rhodium, copper, copper-nickel alloy, the like, or a combination thereof.

DETAILED DESCRIPTION

Figure 1:
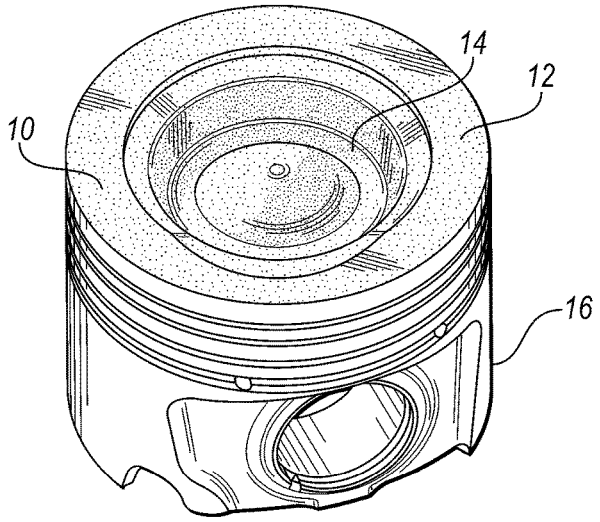
FIG. 1 depicts a perspective view of a piston with a PTWA coating applied to a piston dome surface and a piston bowl surface in accordance with one embodiment.

Reference will now be made in detail to compositions, embodiments, and methods of the present invention known to the inventors. However, it should be understood that disclosed embodiments are merely exemplary of the present invention which may be embodied in various and alternative forms. Therefore, specific details disclosed herein are not to be interpreted as limiting, rather merely as representative bases for teaching one skilled in the art to variously employ the present invention.

Except where expressly indicated, all numerical quantities in this description indicating amounts of material or conditions of reaction and/or use are to be understood as modified by the word "about" in describing the broadest scope of the present invention.

The description of a group or class of materials as suitable for a given purpose in connection with one or more embodiments of the present invention implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

In recent years, Ford and other companies have started using PTWA and other methods for applying thin coatings to cylinder bores. A typical PTWA application involves a thin wear-resistant coating on an aluminum alloy cylinder bore. The main advantages of such application are reduced weight and/or cost and/or bore spacing, compared to an aluminum engine block with thick iron cylinder liners.

The PTWA coatings may be also utilized as a coating for one or more additional parts of the engine. More specifically, the PTWA coating may be utilized in one or more parts of an internal combustion cylinder such as the pistons of diesel and/or gasoline engines, that is pistons of compression ignition and/or spark ignition engines. Piston coatings may be desired not only for wear resistance, but also for improved fatigue strength and/or reduced thermal conductivity. Furthermore, the design of automotive pistons, especially the top land of the pistons above the piston rings, strongly affects crevice volume which is a major source of hydrocarbon emissions. The air-fuel mixture in the crevice volume escapes primary combustion because the flame is quenched before it enters the crevice area between the piston and the cylinder liner. This crevice volume effect also causes a significant fuel efficiency penalty. Decreasing crevice volume effect leads to a gain in fuel efficiency. Therefore, it would be desirable to improve fuel economy and lower hydrocarbon emissions at the same time by reducing the mass of air-fuel mixture in the crevice area. This can be done by application of a PTWA coating to selected areas of the pistons.

Additionally, it is challenging to ensure good cooling and/or fatigue life of certain parts of cylinder heads such as thin bridges between the two exhaust valves, between a spark plug and an exhaust valve, or between a direct injection fuel injector and an exhaust valve, or between a spark plug and a direct injection fuel injector. Therefore, it may be advantageous to coat selected surface of cylinder heads with a PTWA coating to gain benefits such as good cooling and improved fatigue life of the bridges. Furthermore, a PTWA coating application to selected surface of cylinder heads offers additional benefits such as a reduced need for enrichment to control temperature at high loads, which in turn offers benefits in fuel economy and lower emissions.

The PTWA thermal spraying, also called the PTWA surfacing, is a high energy, inert gas welding process, in which a coating is deposited onto a substrate. As was stated above, the PTWA spraying is utilized, for example, in coating cylinder bores of engines. The current method to apply a PTWA coating onto a metallic substrate is achieved by a specially designed plasma wire weld head with separate gas shield and wire feeds along with A/C electrical current. During PTWA spraying, powder and/or a single conductive wire is fed into the system. A supersonic plasma jet melts the wire, atomizes the wire, and propels the melted wire onto a substrate to be coated. The plasma jet is formed by a transferred arc between a tungsten cathode and the wire serving as an anode. Forced gas transports the atomized wire onto the substrate, where the particles flatten when they impinge on the surface of the substrate due to their high kinetic energy. The particles subsequently rapidly solidify and form a highly wear-resistant coating.

According to one or more embodiments, the PTWA coating may be applied to the surface of pistons and/or cylinder heads and/or cylinder bores of compression ignition and/or spark ignition engines including central direct injection, side direct injection, and/or port fuel injection applications. The type of engine determines specific surface of pistons and or/cylinder heads and/or cylinder bores to which the PTWA coating is to be applied. Besides an overall improvement of fuel efficiency and lower hydrocarbon emissions, the coating may provide further advantages to the pistons and/or cylinder heads and/or cylinder bores. For example, the coating on at least selected surface of the piston and/or cylinder head and/or cylinder bores may provide improved wear resistance, improved fatigue strength, and/or reduced thermal conductivity.

In one embodiment, the whole surface of the pistons may be PTWA coated. Alternatively, only selected surface areas of the pistons may be PTWA coated. Coating the entire surface of a piston is especially advantageous on pistons of compression ignition engines while coating of only selected surface areas is advantageous on pistons of spark ignition engines. In one embodiment, the entire surface area of pistons of a compression ignition engine is PTWA coated. Coating the entire surface of the pistons of a compression ignition engine may provide better CO and/or soot emission control and/or improve fuel efficiency. However, only the surface which comes in direct contact with the fuel should be coated to increase temperature and thus increase fuel evaporation. As can be seen in FIG. 1, a PTWA coating 10 is applied to the entire surface of the piston dome 12 and the bowl surface area 14 of a diesel piston 16.

In another embodiment, only selected surface 20 of the piston is PTWA coated. Specifically, on spark ignition engines, it is not advantageous to coat the entire piston surface because higher temperatures exacerbate engine knock at high loads. As can be seen in FIGS. 2-5 depicting a PTWA coating 10 on a gasoline piston 18, among the selected surface areas to be coated 20 may be the top ring groove surface 22, where cast-in reinforcement is used as a common alternative in many designs. Replacing the cast-in reinforcement with a PTWA coating reduces the weight of the piston, which is important for noise, vibration, and harness characteristics of a vehicle. The PTWA coating 10 at the top ring groove surface 22 may also translate into cost savings.

Figure 2:
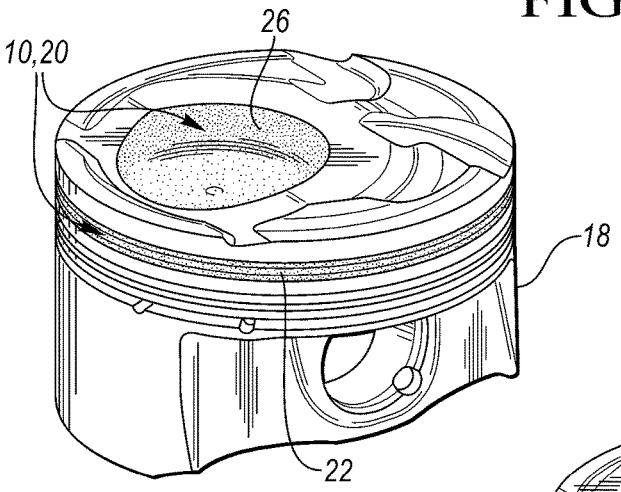
FIG. 2 depicts a perspective view of a piston with a PTWA coating applied to a top ring groove surface and a piston bowl surface in accordance with one embodiment.

An additional surface to be coated 20 on a piston of a spark ignition engine 18 is the surface of a piston bowl 26, as depicted in FIG. 2. The PTWA coating 10 on this surface of a piston 18 increases gas temperature near a spark plug to improve combustion stability and reduce feed gas hydrocarbons immediately after a cold start.

Figure 3:
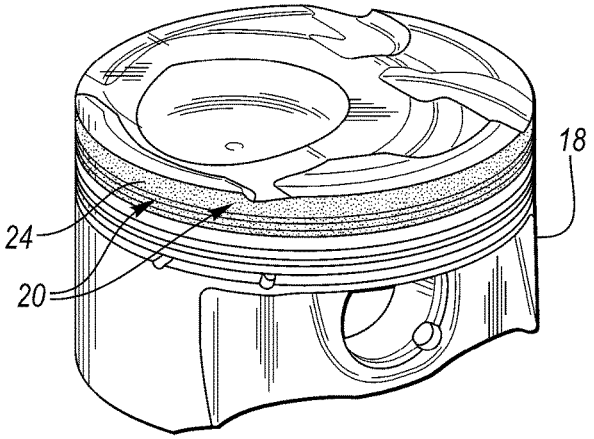
FIG. 3 depicts a perspective view of a piston with a PTWA coating applied to a top ring land surface in accordance with one embodiment.
Figure 5:
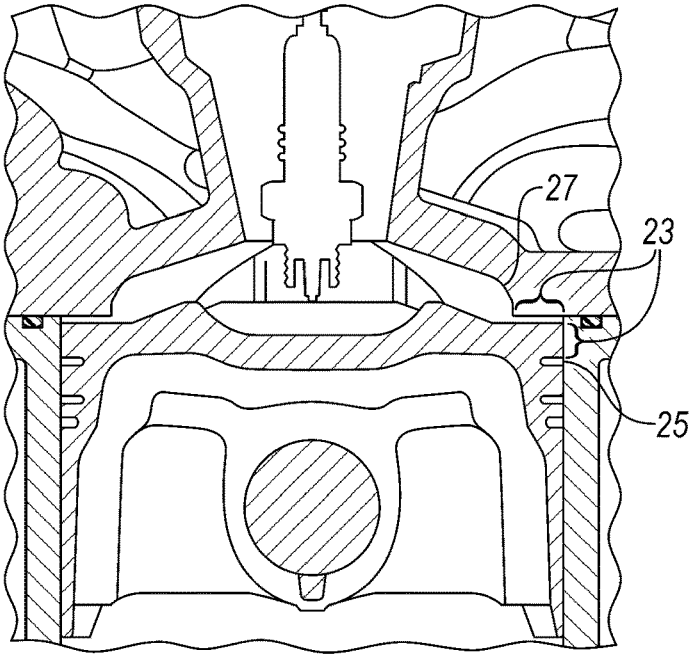
FIG. 5 illustrates a sectional view of a cylinder head along the line 5-5 in FIG. 4, depicting crevice volume as an area between a top ring of a piston and a combustion roof.

Another selected surface to be coated 20 on a piston of a spark ignition engine 18 is a top ring land surface 24, as depicted in FIG. 3. The crevice volume 23, defined as a region between a piston top ring 25 and a combustion chamber roof 27 is depicted in FIG. 5. The crevice volume 23 is known to be a major source of hydrocarbon emissions as the air-fuel mixture in the crevice volume 23 escapes primary combustion. The PTWA coating 10 on this surface of a piston 18 reduces thermal conductivity of the top ring land 24 which increases temperature of the air-fuel mixture in the crevice volume 23 and reduces density and mass of air-fuel mixture in the crevice volume 23. Additionally, utilizing the PTWA coating on the top ring land surface 24 improves structural strength of the top ring land 24 which allows for reduced height of the top ring land 24, which in turn reduces the size of the crevice volume 23.

Figure 6:
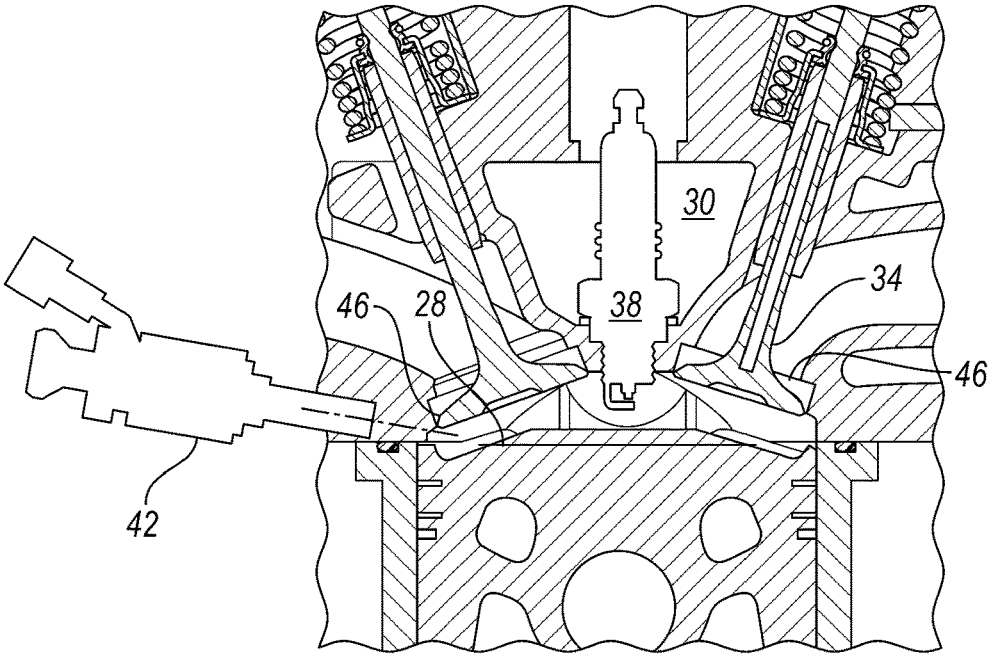
FIG. 6 shows a sectional view along the line 6-6 of FIG. 4, depicting a cylinder head with the PTWA coating applied to the selective areas.

The PTWA coating 10 may also be applied to the piston surface in the area below intake valves 28 to reduce heat transfer losses and improve fuel efficiency. The piston surface below the intake valves 28, as depicted in FIG. 6, is generally cooler than the piston surface below the exhaust valve, and therefore does not tend to contribute to knock.

Figure 4:
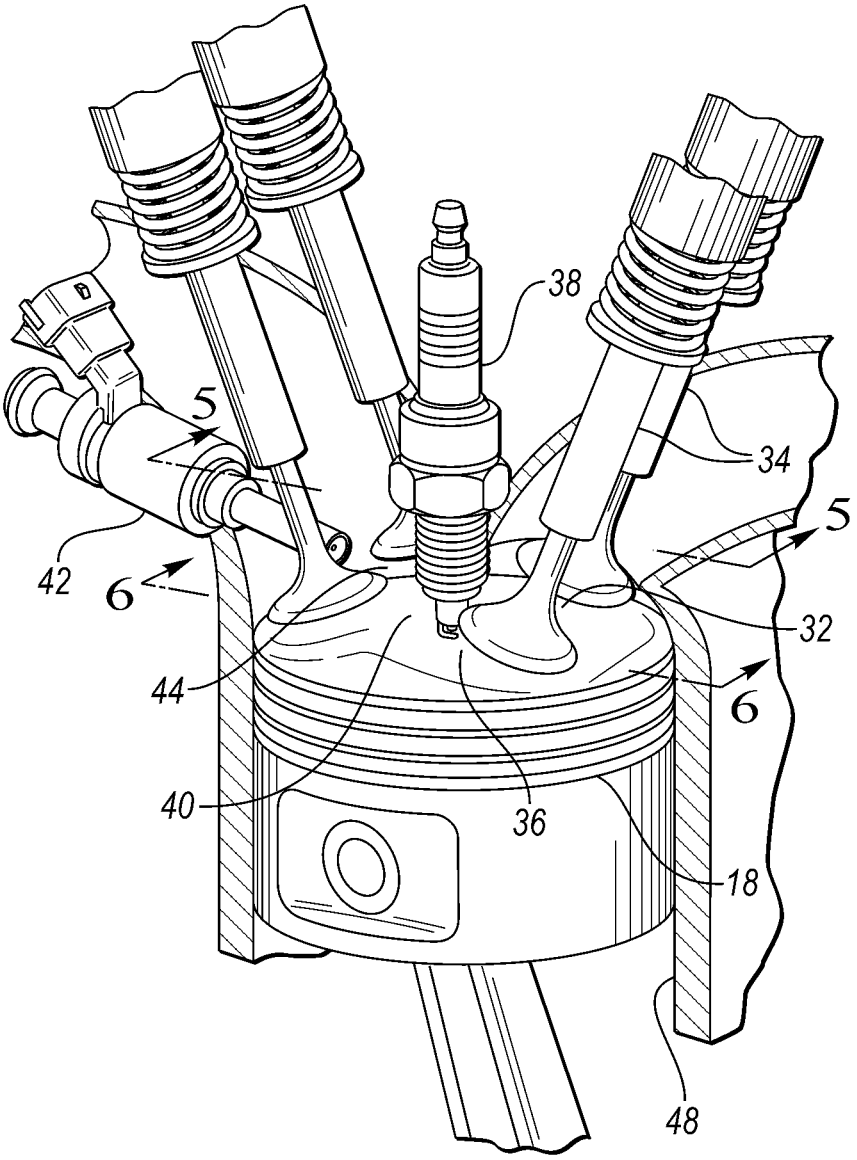
FIG. 4 illustrates a perspective view of a cylinder head, a piston, and a cylinder bore with the PTWA coating applied to the surface of the cylinder bore and to the selective areas of the cylinder head.

According to one or more embodiments, the PTWA coating 10 may be applied to one or more selected surface areas of cylinder heads 30. It is desirable to coat only certain surface of cylinder heads 30, as is depicted in FIGS. 4 and 6. Specifically, it is desirable to coat the surface where unspent residual fuel containing hydrocarbons and other byproducts of combustion tends to accumulate, and/or where temperature is highest, and/or where stresses are highest. For example, it is desirable to prevent accumulation of unspent fuel around spark plugs 38 and direct injection fuel injectors 42. Specifically, application of the PTWA coating 10 is useful especially on the following surface areas of the cylinder heads 30: a bridge surface 32 between two exhaust valves 34, a bridge surface 36 between a spark plug 38 and an exhaust valve 34, a bridge surface 40 between a direct injection fuel injector 42 and an exhaust valve 34, and a bridge surface 44 between a spark plug 38 and a direct injection fuel injector 42. The PTWA coating 10 may also be applied to a surface of valve seats 46 which removes the need to install valve seat inserts. The PTWA coating 10 at these surface areas helps to increase fatigue life of these areas, ensures good cooling by reducing heat buildup, and prevents spark plugs 38 from getting wet.

Specifically, the PTWA coating 10 acts as a thermal barrier and directs combustion heat to a region of the combustion chamber in a predictable manner. The PTWA coating 10 thus helps to reduce a need for enrichment to control temperature at high loads, which in turn offers benefits in fuel economy and better hydrocarbon emissions, for example as tested according to US06 Supplemental Federal Test Procedure (SFTP). Additionally, the PTWA coating 10 in these surface areas offers one or more additional benefits of less packaging constraint on the diameter of valves for higher power, lower cost of spark plugs, improved durability of spark plugs, lower cost of direct injection fuel injectors, improved fuel spray of direct injection fuel injectors, or a combination thereof which translates into lower emissions and increased fuel efficiency.

In one or more embodiments, it is desirable to coat an inner surface of a cylinder bore 48 with the PTWA coating 10, as is depicted in FIG. 4. A cylinder bore may have fuel impingement on the cylinder bore 48 from a fuel spray pattern and/or geometric placement of the cylinder bore within the engine. Therefore, it may be desirable to coat a portion or an entire inner surface of a cylinder bore 48. In one embodiment, an inner surface of a cylinder bore 48 of a side direct injection or port fuel injection engine may be coated with the PTWA coating.

The surface of the pistons and/or cylinder heads and/or cylinder bores to be PTWA coated may be pretreated using a variety of techniques to enhance the bond and adhesive strength. For example, the surface to be PTWA coated may be pretreated to enhance texture. In one or more embodiments, the surface to be PTWA coated may be prepared by applying water-jet, by casting, burnishing, polishing, turning, and/or any other technique. The surface to be PTWA treated may be pre-coated with a bond coat. The texture of the surface to be PTWA coated may have a raw semi-finished consistency. The surface to be PTWA coated may be smooth or rough. The surface to be PTWA coated may be micro serrated. The surface to be PTWA coated may be prepared by mechanical roughening. The peak to valley depth of the mechanical roughened surface may be about 1 μm or more, about 30 μm or more, or about 60 μm or more.

Figure 7:
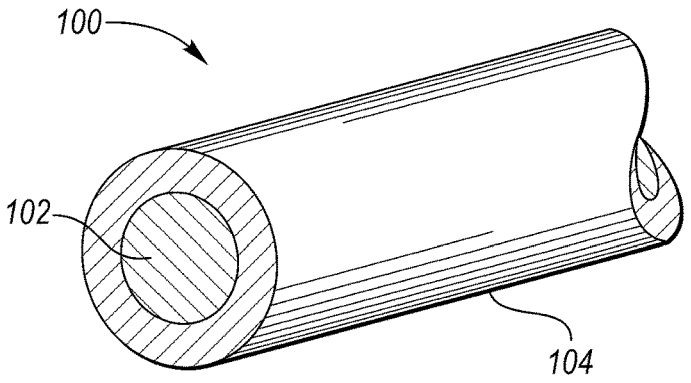
FIG. 7 illustrates a schematic view of a flux core wire used according to one embodiment.

As can be seen in FIG. 7, the coating wire 100 to be used for the PTWA coating 10 of pistons and/or cylinder heads comprises a core 102 and a carrier 104. The PTWA coating 100 is applied instead of a typical ceramic coating or nitrating. The coating wire 100 may be a flux core wire used in the welding industry.

The core 102 may contain one or more hydrocarbon reagents. The core 102 of the coating wire 100 may contain one or more materials which are utilized in a catalytic converter so that the PTWA coating 10 is similar to catalytic converter coatings. The PTWA coating 10 thus helps to prevent unspent hydrocarbons from collecting on the surface areas of the pistons and/or cylinder heads exposed directly to combustion heat and pressure, and allows for emission reduction and increased fuel economy at the same time. The core 102 may have solid, paste-solid, or paste consistency.

The core 102 may contain components typically used in a washcoat of catalytic converter coatings. These components provide maximum possible surface area for reactions to take place. The components may comprise alumina, cerium, lanthanides, scandium, yttrium, the like, or a combination thereof. The core 102 may further comprise one or more catalytic metals dispersed within the washcoat components to promote chemical reactions. The catalytic metals may include platinum, palladium, rhodium, copper, copper-nickel alloy, the like, or a combination thereof.

The carrier 104 may comprise one or more carrier wires 106. The one or more carrier wires 106 may comprise various grades of steel, mild and low alloy steel, stainless steel, aluminum, zirconium, tungsten carbide, the like, or a combination thereof. The one or more carrier wires 106 may comprise one or more alloys such as soft alloys, medium hard alloys, or hard alloys, soft alloys with hard abrasion-resistant particles dispersed in the matrix, alloys of aluminum and bronze, nickel-aluminum alloys, high nickel alloys, wear facing/surfacing alloys, the like, or a combination thereof.

The applied PTWA coating 10 may have a varying or uniform thickness. The thickness of the coating 10 may vary according to needs of a specific application. The thickness of the coating 10 has to be such as to ensure that the coating stays adhered to the surface to be coated. The thickness of the PTWA coating 10 may be about 200 μm or less, about 150 μm or less, about 100 μm or less, about 75 μm or less, about 50 μm or less, or about 25 μm or less. The thickness of the thermal coating 10 may be about 10 μm or more, about 30 μm or more, about 70 μm or more, about 90 μm, or about 120 μm or more. The PTWA coating 10 may be about 30-70

μm thick after being applied by the wire weld head. The target PTWA coating thickness may be about 25-50 μm.

In one or more embodiments, the PTWA coating 10 may be subsequently treated, for example by polishing, to remove some of the coating's thickness. About 1% or more, 5% or more, 25% or more, 50% or more, 75% or more, or 99% or more of the applied PTWA coating thickness may be removed in one or more subsequent steps. In one exemplary embodiment, the thickness of the PTWA coating 10 may be reduced by about 50% from about 50 μm before polishing to about 25 μm after polishing.

The method of applying a PTWA coating 10 on at least one selected surface area of a piston and/or a cylinder head is achieved by a torch comprising plasma wire weld head with separate gas shield and wire feeds with A/C electrical current. The wire weld head may be a wire weld head developed for PTWA thermal coating of cylinder bores. The wire weld head and/or additional parts of the process may be controlled robotically. The process may be at least partially programmed and/or automated.

The method may comprise applying a PTWA coating 10 at a precise point during the manufacturing process of the pistons and/or cylinder heads. For example, the method may comprise applying a PTWA coating 10 to a cylinder head after completing a cubing operation and/or roughing cut. Application at this stage allows for location control of the cylinder head while coating the combustion chambers accurately. The method may comprise applying a PTWA coating 10 to the pistons before the pistons are balanced so that extra weight is not added to the pistons.

The method may comprise pretreating surface of pistons and/or cylinder heads and/or cylinder bores as was described above. The method may comprise a step of preparing a wire comprising one or more materials which are utilized in a catalytic converter so that the PTWA coating is similar to catalytic converter coatings as was described above.

Figure 8A:
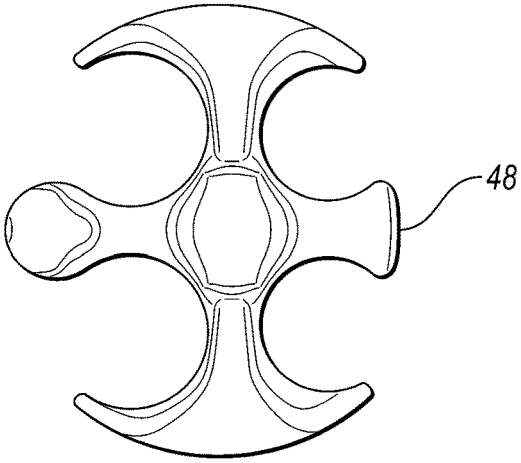
FIG. 8A illustrates a perspective top view of a masking template in accordance with one embodiment.
Figure 8B:
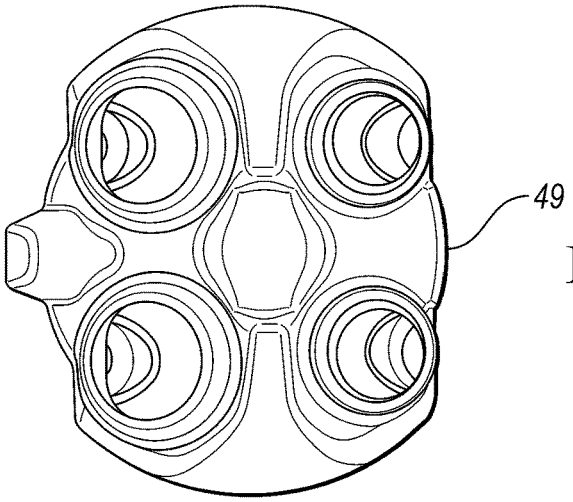
FIG. 8B illustrated a perspective top view of an as-cast combustion chamber on a typical four valve cylinder head to which the PTWA coating is applied.

The method may further comprise a step of controlling a boundary and/or a shape of a thermal coating to be applied by using one or more masking templates 48. The masking template 48 serves as a stencil, covering surface which is to remain free of the PTWA coating and exposing surface which is to be coated 20. A masking template 48 can be used on the pistons and/or cylinder heads before the pistons and/or cylinders heads are advanced to receive the PTWA coating. As can be seen in FIG. 8A, a masking template 48 is to be placed above an as-cast combustion chamber on a four valve cylinder head 49, depicted in FIG. 8B. The masking template 48 is made out of a material which withstands high temperature of the PTWA process. For example, the masking template 48 is made out of steel or coated steel. The masking template 48 can be reused. In one embodiment, after the masking template 48 is removed from the piston and/or cylinder head 49 which has been coated, the masking template 48 can be cleaned by media blasting or otherwise, the masking template 48 may be recut or otherwise refurbished.

The method may further comprise a step of feeding the coating material in the form of a coating wire into the plasma arc. The wire serves as an anode. The method may comprise a step of creating an arc between the cathode and the wire.

The method may further comprise setting parameters of the application to yield desired results. For example, the distance of the piston and/or cylinder head to be coated from the wire weld head, a wire feed rate, and other variables such as arc current, arc voltage, plasma gas flow rate, shield gas flow rate, welding speed, and/or speed of oscillation, will determine the thickness of the thermal coating as well as the surface texture of the coating on the substrate. The thickness of the coating on the substrate may be built up to any desired level by repeating the process and/or reduced in one or more subsequent steps. The cycle time depends on the dimensions of the piston and/or cylinder head.

Preferably, the speed of the torch head is about 30 m/s or less, about 20 m/s or less, or 10 m/s or less. Preferably, the speed of the torch head is about 25 m/s or more, about 35 m/s or more, or about 45 m/s or more. More preferably, the speed of the torch head is about 40 m/s. Preferably, the wire feed rate is about 20 m/s or less, about 10 m/s or less, or about 5 m/s less. Preferably, the wire feed rate is about 15 m/s or more, about 25 m/s or more, or about 35 m/s or more. More preferably, the wire feed rate is about 23-24 m/s. Preferably, the shield gas pressure is about 80-120 psi. More preferably, the shield gas pressure is about 100 psi. Preferably, the plasma gas flow is about 60-100, more preferably about 88 amps. The cycle time may be less than 1 minute, or about 1 minute, or more than 1 minute.

The method may further comprise a step of fixing the piston or cylinder head or cylinder bore to be coated at a distance from the wire weld head and moving the wire weld head towards the piston or cylinder head. Alternatively, the piston and/or cylinder head and/or cylinder bore can be advanced towards the wire weld head that is fixed at a predetermined distance. The latter may be beneficial especially concerning mass production as pistons and/or cylinder heads and/or cylinder bores can be advanced toward the weld head on a carousel, automatic conveyer, or another platform utilized for mass production. Because the plasma spray pattern out of the wire weld head has a conical shape, it may be beneficial to control the deposition of the coating by programming a path of a robot holding the wire weld head or alternatively, holding the piston and/or cylinder head to be coated.

The method further includes generating plasma, atomizing the wire, blowing the atomized wire to the exposed surface of the piston and/or cylinder head by the shield gas. The method may include a step of creating a PTWA coating of a thickness of about 100 μm or less, about 75 μm or less, about 50 μm or less, or about 25 μm or less. The method may include creating a PTWA coating of a thickness of about 10 μm or more, about 30 μm or more, about 70 μm or more, or about 90 μm or more. The method may include achieving a PTWA coating of a thickness of about 25-50 μm.

The method may further comprise a step of cooling the surface of the piston and/or cylinder head and/or cylinder bores. Preferably, the PTWA coated surface of the piston and/or cylinder head and/or cylinder bores is cooled to the touch of the human hand before the surface is roughened to the desired texture and/or thickness. The method may further comprise removing the masking template.

The method may comprise achieving desired texture and/or thickness of the PTWA coating by polishing, roughening, burnishing, machining, the like, or a combination thereof. The method may include a step of achieving a desired thickness of about 25-50 μm. The method may further comprise a step of machining away one or more areas of the piston and/or cylinder head and/or cylinder bore and/or removing overspray from one or more areas of the piston and/or cylinder head and/or cylinder bore.

By using the PTWA process to selectively coat pistons and/or cylinder heads and/or cylinder bores, a better adhesion over thermal expansion is achieved when compared to other coating methods. During combustion, a PTWA coating stays adhered to the moving surface of the aluminum head under thermal expansion and contraction from about −40 to about 1800° C. Therefore, the present disclosure allows for a more thermo-dynamically and mechanically efficient way of managing thermal gradient within the structure of the block and the head due to the specific coated surface of the pistons and/or cylinder heads and/or cylinder bores.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method comprising:

using a masking template, selectively masking a surface portion of a combustion chamber roof of a cylinder head of an internal combustion engine cylinder to obtain a masked portion and an exposed portion that includes a bridge surface; and applying a plasma transferred wire arc (PTWA) material to the exposed portion to obtain a selective PTWA coating; and roughening the cylinder head to about a 60 μm peak-to-valley depth.

2. The method of claim 1, wherein the applying step includes applying the PTWA material to the exposed portion such that the masking template inhibits application of the PTWA material to the masked portion.

3. The method of claim 1, wherein the PTWA coating material includes one or more catalytic materials including platinum, palladium, rhodium, or a combination thereof.

4. The method of claim 1, further comprising smoothing the selective PTWA coating by burnishing and/or wire brushing to obtain a smoothed selective PTWA coating.

5. The method of claim 4, wherein the smoothed PTWA coating has a thickness of about 25-50 μm.

6. The method of claim 1, wherein a selective PTWA coating has a thickness of about 90-150 μm.

7. The method of claim 1, wherein the masking template includes steel.

8. A method comprising:

selectively masking a surface portion of a combustion chamber roof of an internal combustion engine cylinder head to obtain a masked portion and an exposed portion including bridge surfaces extending between exhaust valves and between a spark plug and an exhaust valve;

applying a plasma transferred wire arc (PTWA) material to the exposed portion to obtain a selective PTWA coating; and roughening the cylinder head to about a 60 μm peak-to-valley depth.

9. An internal combustion cylinder comprising:

a cylinder head having a cylinder head surface roughened to about a 60 μm peak-to-valley depth;

a piston having a piston surface that includes a ring land surface disposed between adjacent groove surfaces;

a cylinder bore having a cylinder bore surface; and a selective plasma transferred wire arc ("PTWA") coating contacting the cylinder head surface, the piston surface, and the cylinder bore surface.

10. The internal combustion cylinder of claim 9, wherein the piston surface includes a groove surface extending about a side surface of the piston.

11. The method of claim 9, further comprising smoothing the surface of the PTWA coated piston by burnishing and/or wire brushing to obtain a smoothed PTWA coating.

12. The method of claim 11, wherein the smoothed PTWA coating has a thickness of about 25-50 μm.

13. The method of claim 9, wherein a deposited PTWA material has a thickness of about 90-150 μm.

14. The internal combustion cylinder of claim 9, wherein the PTWA coating material includes one or more catalytic materials including platinum, palladium, rhodium, copper, a copper-nickel alloy, or a combination thereof.

15. The internal combustion cylinder of claim 9, wherein the piston surface includes a top ring land surface disposed between a groove and a top surface of the piston.

16. The internal combustion cylinder of claim 9, wherein the piston surface includes a bowl surface area disposed at a top surface of the piston.

* * * * *